US012070107B2

(12) United States Patent
Retrouvey et al.

(10) Patent No.: US 12,070,107 B2
(45) Date of Patent: Aug. 27, 2024

(54) WRISTLET WITH LINKS MADE OF A HARD MATERIAL

(71) Applicant: Comadur SA, Le Locle (CH)

(72) Inventors: Sébastien Retrouvey, Chissey sur Loue (FR); Anthony Tapiz-Delgado, Noel Cerneux (FR)

(73) Assignee: Comadur SA, Le Locle (CH)

( * ) Notice: Subject to any disclaimer, the term of this patent is extended or adjusted under 35 U.S.C. 154(b) by 0 days.

(21) Appl. No.: 18/163,967

(22) Filed: Feb. 3, 2023

(65) Prior Publication Data

US 2024/0000200 A1 Jan. 4, 2024

(30) Foreign Application Priority Data

Jun. 30, 2022 (EP) ..... 22182360

(51) Int. Cl.
*A44C 5/10* (2006.01)
*A44C 5/02* (2006.01)

(52) U.S. Cl.
CPC ..... *A44C 5/02* (2013.01)

(58) Field of Classification Search
CPC ..... A44C 5/105; A44C 5/107; A44C 5/02; G04B 37/0008
See application file for complete search history.

(56) References Cited

U.S. PATENT DOCUMENTS 6,079,196 A 6/2000 Linder et al.

FOREIGN PATENT DOCUMENTS

| | | | | |
|---|---|---|---|---|
| CH | 617579 A5 * | 6/1980 | | |
| EP | 1169935 A1 * | 1/2002 | ..... | A44C 5/107 |
| EP | 1186252 A1 * | 3/2002 | ..... | A44C 5/107 |
| FR | 623893 A * | 7/1927 | | |
| WO | WO 98/08408 A1 | 3/1998 | | |

OTHER PUBLICATIONS

European Search Report issued Nov. 15, 2022 in European Application 22182360.2 filed Jun. 30, 2022, 4 pages (with English Translation of Categories of cited documents).

* cited by examiner

*Primary Examiner* — Jack W Lavinder
(74) *Attorney, Agent, or Firm* — Oblon, McClelland, Maier & Neustadt, L.L.P.

(57) ABSTRACT

A wristlet including a first row with at least one central link, a second row and a third row disposed respectively on either side of the first row and each including at least one lateral link, a connecting rod positioned in the three aligned holes of the first, second and third rows. The lateral link is hollow and includes in its hollow an insert delimited by two external lateral walls, the connecting rod including at each end a first banking and a second banking respectively bearing on a portion of the external lateral wall when the lateral link pivots about the connecting rod so as to limit the amplitude of rotation of the central link about the connecting rod.

17 Claims, 6 Drawing Sheets

WRISTLET WITH LINKS MADE OF A HARD MATERIAL

CROSS-REFERENCE TO RELATED APPLICATION

This application claims priority to European Patent Application No. 22182360.2 filed on Jun. 30, 2022, the entire disclosure of which is hereby incorporated herein by reference.

TECHNICAL FIELD OF THE INVENTION

The invention relates to a wristlet formed by elements that are hinged together, in particular by links at least some of which are made of a hard material. It also relates to a piece, including a timepiece such as a watch or a jewellery piece, comprising said wristlet.

TECHNOLOGICAL BACKGROUND

In the watchmaking or jewellery making industry, various materials are used for the manufacture of wristlets with various appearances. In particular, it is known to manufacture wristlets made of a hard material. By hard material, it should be understood the materials having a Vickers hardness higher than 1,200 HV. For example, these hard materials are ceramic such as silicon nitride, zirconium oxide or aluminium oxide. It may also consist of ceramels. Hard materials are used for their mechanical properties, in particular because they are hardly scratched.

The disadvantage of these materials is their fragility with an increased risk of breakage during machining and when the links of the wristlet move, or collide, relative to each other during handling of the wristlet.

SUMMARY OF THE INVENTION

The present invention aims to overcome the aforementioned drawbacks by providing an assembly between the links allowing controlling the amplitude of rotation of the links so as to avoid collisions.

For this purpose, the connecting rods that connect the different rows of the wristlet include at each end two bankings which respectively bear on an insert fitted within the lateral links which surround the central links. These two bankings limit the angular movement of the lateral links relative to the connecting rod.

More specifically, the present invention relates to a wristlet comprising:

- a first row with at least one central link provided with two open-through holes, said holes of the central link,
- a second row and a third row disposed respectively on either side of the first row, the second row and the third row each comprising at least one lateral link, said lateral link being provided with two holes, called holes of the lateral link, with a hole of the lateral link of the second row aligned on a hole of the central link of the first row and on a hole of the lateral link of the third row to form a set with three aligned holes,
- a connecting rod positioned in the three aligned holes, said connecting rod being fixedly mounted with respect to the central link of the first row and forming an axis about which the lateral link of the second row and of the third row is pivotally mounted,
- the wristlet being characterised in that the lateral link is hollow and includes in its hollow an insert delimited by two external lateral walls, the connecting rod comprising at each end a first banking and a second banking respectively bearing on a portion of the external lateral wall when the lateral link pivots about the connecting rod so as to limit the amplitude of rotation of said lateral link about the connecting rod.

Thus, according to the invention, the axes serving as junctions and pivots between the links are used to limit the amplitude of rotation of the links and absorb all or part of the stresses upon abutment. These axes as well as the insert are protected from outside by the links and can therefore be made of a material that is less hard such as steel or a titanium alloy, which facilitates machining thereof.

Furthermore, the central link includes a protruding portion, also called coverage area, which extends in the second and third rows between the lateral links. This protruding portion of the central link as well as the lateral link have a particular shape which confers an aesthetic touch on the wristlet without any contact between the protruding portion and the lateral links when the central link pivots. This absence of contact allows avoiding stressing of the links made of the hard material.

To conclude, the assembly of the wristlet according to the invention allows controlling the extent of movability of the links of a wristlet made of a hard material with a design including coverage areas in order to ensure solidity thereof while avoiding collisions or stressing of fragile portions made of a hard material during handling thereof.

Further features and advantages of the present invention will become apparent in the following description of a preferred embodiment, given by way of non-limiting example with reference to the appended drawings.

DETAILED DESCRIPTION OF THE INVENTION

Figure 1:
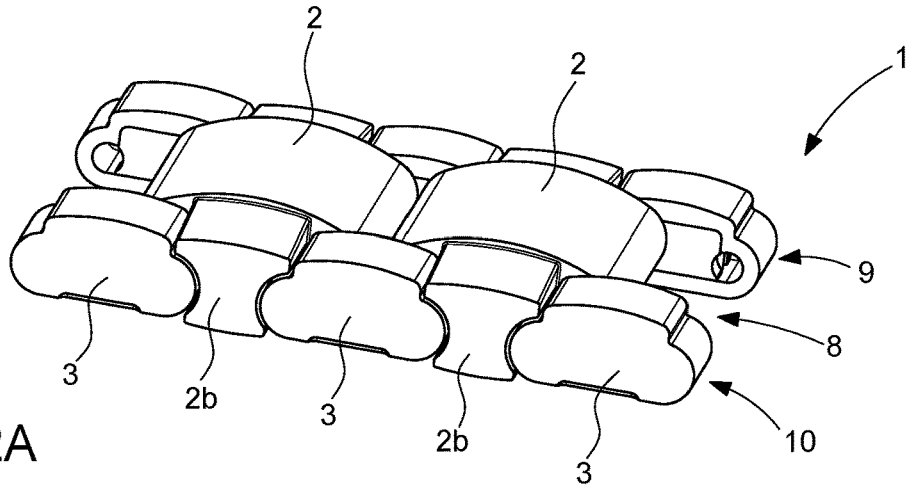
FIG. 1 is a three-dimensional partial view of the wristlet according to the invention.

The present invention relates to a wristlet 1 comprising at least three rows of links with a first row 8 comprising the central links 2 and, a second row 9 and a third row 10 on either side of the first row 8 comprising the lateral links 3. A partial view of this wristlet 1 with two adjacent central links 2 and three lateral links 3 is represented in FIG. 1. For example, this wristlet is intended to equip a timepiece such as a watch or a jewellery piece. More specifically, the assembly as described hereinafter is suited for a wristlet some links of which are at least partially made of a hard material. By hard material, it should be understood a material whose hardness is substantially equal to or higher than 1,200 HV and which withstands little plastic deformation, or not at all, before breaking up. As a hard material, mention may be made, without limitation, of enamels, stones, precious or not, such as ruby, sapphire or quartz, ceramics such as an oxide, a carbide or a nitride, ceramels or hard metals. It should be noted that although the assembly is specifically suited for links made of a hard material, it also applies for links made of more ductile materials.

Figure 4A:
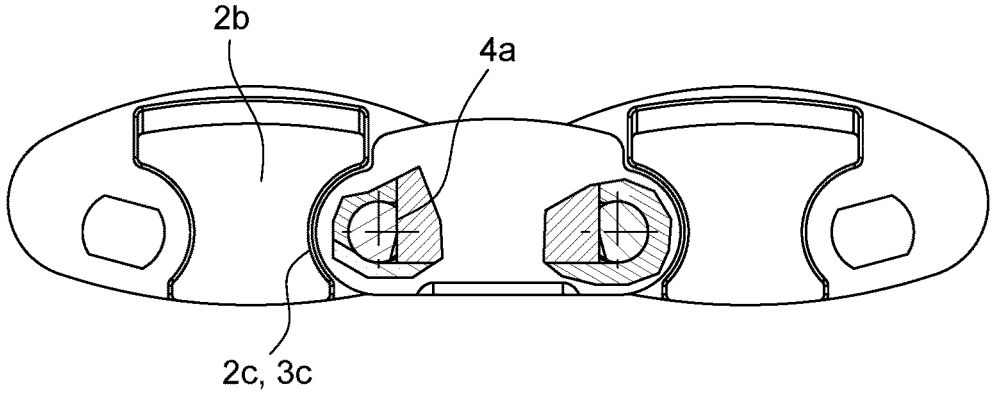
FIGS. 4A and 4B are partial sectional views of a portion of the wristlet respectively in the flat position and in the pivoted position.
Figure 4B:
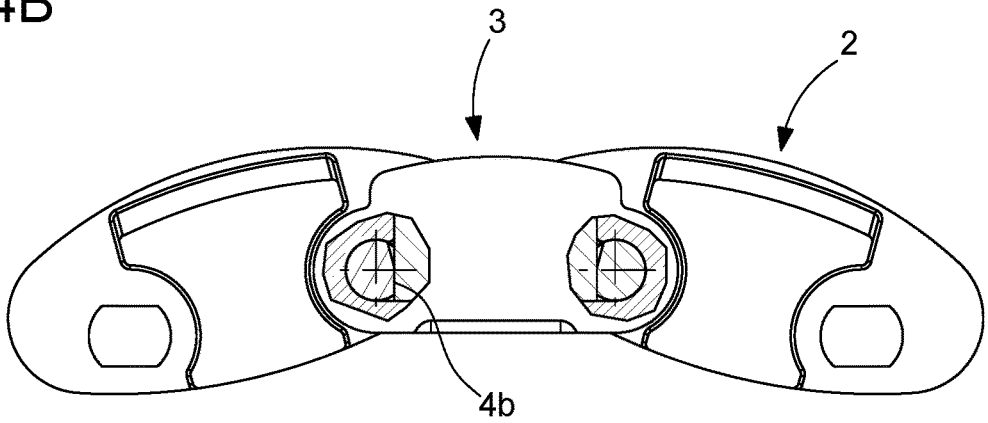
Figure 7A:
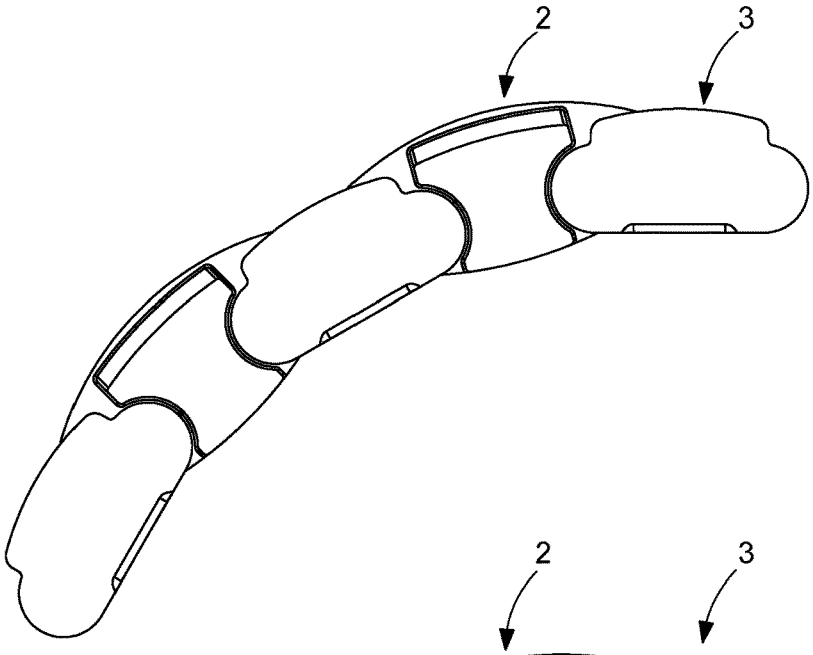
FIG. 7A is a side view of the wristlet in the pivoted position.
Figure 7B:
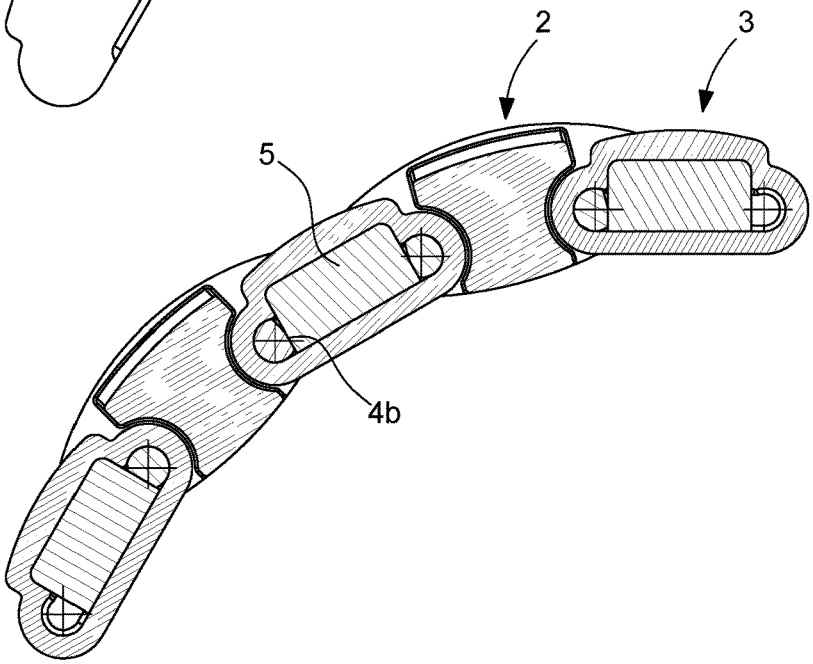
FIG. 7B is a sectional view of FIG. 7A with an enlargement in FIG. 7C.
Figure 7C:
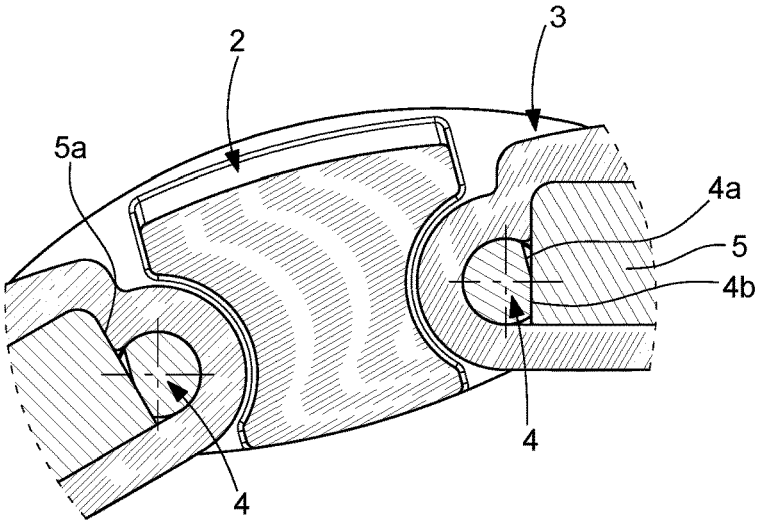
Figure 8:
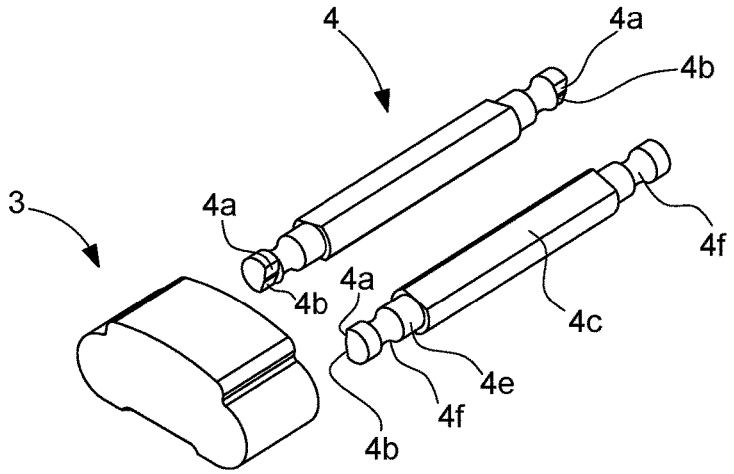
FIGS. 8 to 10 are views of a portion of the wristlet during assembly.
Figure 9:
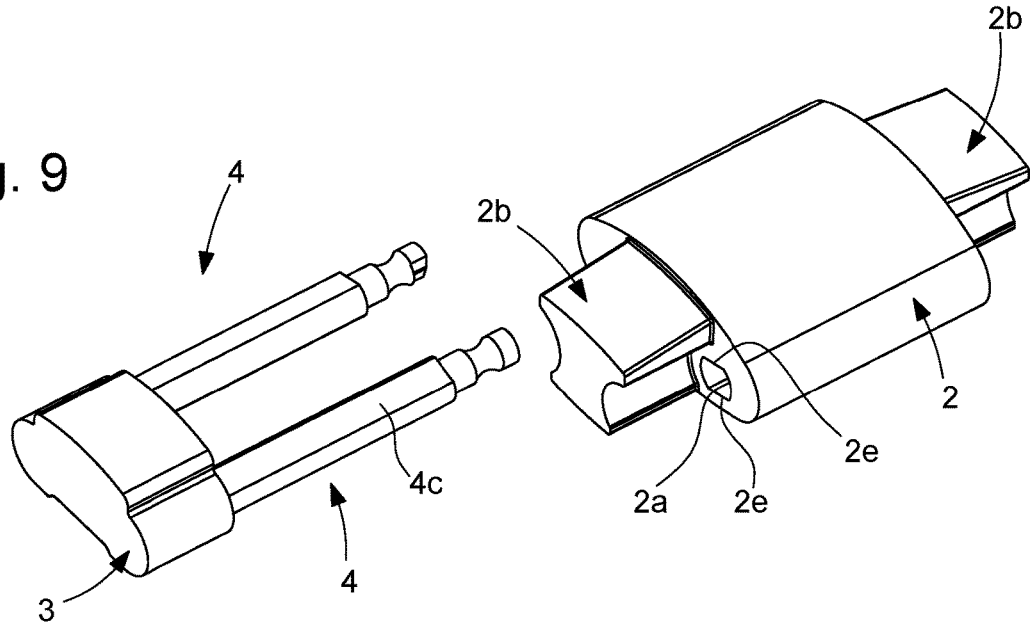
Figure 11:
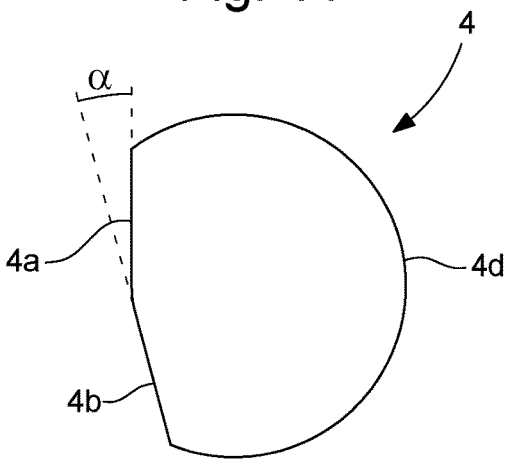
FIG. 11 is a section of the end of the connecting rod with the angle $\alpha$ between the two flat surfaces.

According to the invention and as illustrated in FIGS. 4B and 7A, the amplitude of rotation of the links is limited. For this purpose, the connecting rod 4 between the central link 2 and the two lateral links 3 includes at each end two adjacent flat surfaces 4*a*, 4*b* which respectively form a first banking and a second banking for the lateral link 3 when it pivots (FIGS. 7C, 8 and 11).

Figure 3:
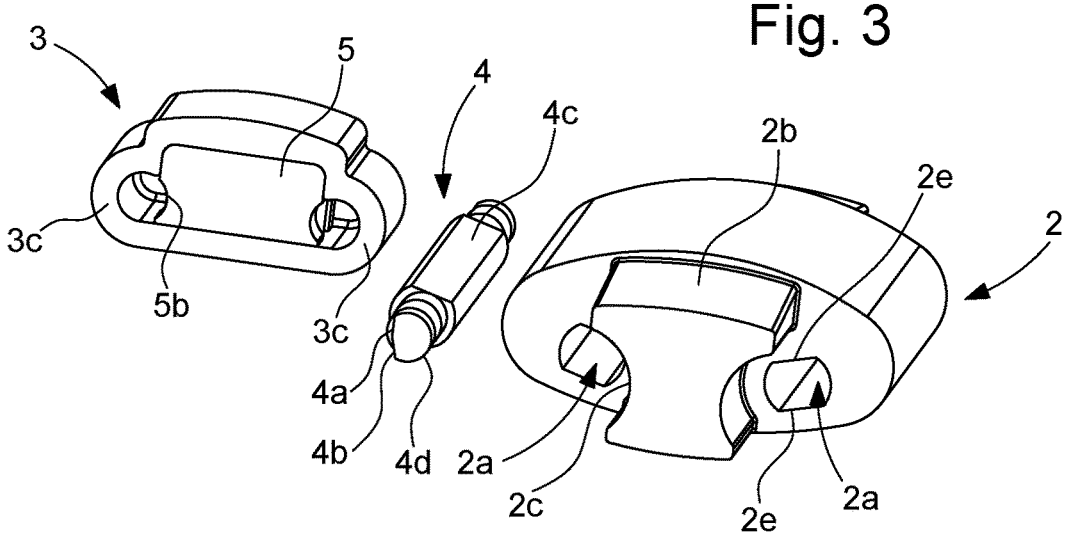
FIG. 3 is a three-dimensional view of the central link, of the lateral link and of the connecting rod according to the invention.

In a known manner, the central link 2 includes two open-through holes 2*a* each intended to receive the connecting rod 4, which will be also referred to as axis. According to the invention, the connecting rod 4 is secured to the central link 2 and the lateral links 3 have a rotational relative movement about the axis formed by the connecting rod, relative to this secured block formed by the connecting rod and the central link. To secure the connecting rod and the central link, there are several possibilities. Preferably, the connecting rod has a portion with a non-circular section at each of its ends which is positioned in the open-through holes of the central link which have a non-circular section too. For example, the portion with a non-circular section of the connecting rod includes at least one flat surface 4*c* which is positioned against a plane 2*e* inside the open-through hole 2*a* of the central link 2. In the illustrated example, the portion with a non-circular section includes two flat surfaces 4*c*, for example diametrically opposite, which are positioned against two planes 2*e* which delimit the open-through hole 2*a* of the central link 2 (FIGS. 3 and 6C). Fastening could also be achieved by gluing within the open-through hole of the central link. Alternatively, fastening of the connecting rod within the open-through hole of the central link could simply be achieved by gluing without requiring a non-circular section at the connecting rod and the open-through hole.

Figure 2A:
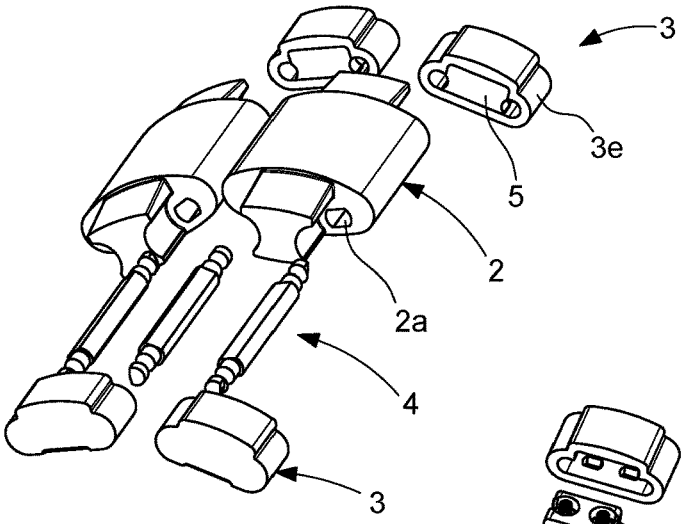
FIGS. 2A and 2B are exploded and three-dimensional partial views of the wristlet according to the invention.
Figure 2B:
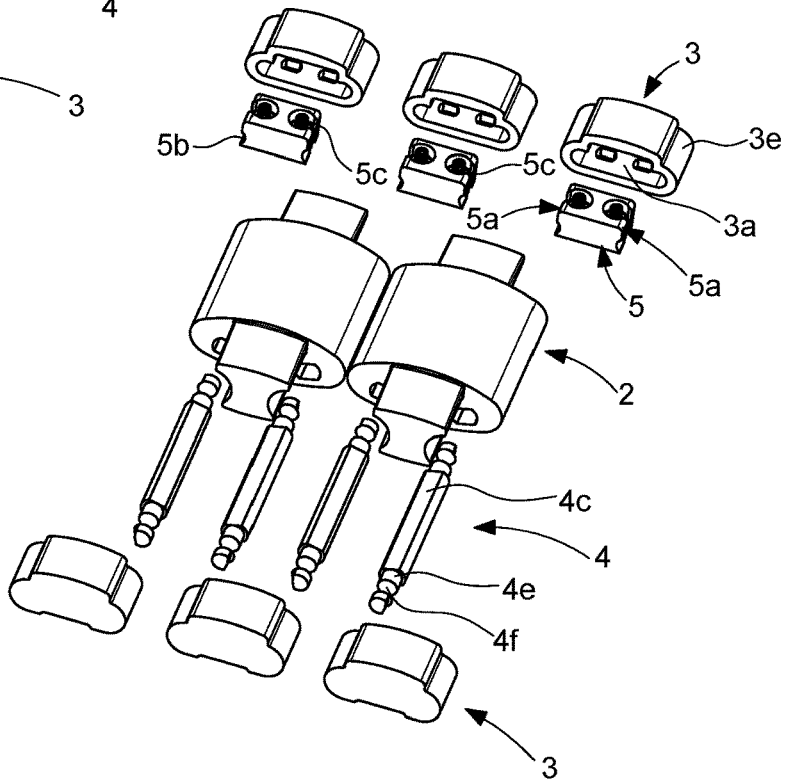

According to the invention, the lateral link 3 is hollow and provided with an insert 5 which is disposed within the hollow 3*a* (FIG. 2B). Thus, the lateral link 3 is composed by a cap 3*e* which confers the external appearance of the lateral link. The lateral link is made of the hard material that ensures good resistance to scratches whereas the insert is hidden within the cap. Henceforth, this insert, as well as the connecting rod concealed within the links, can be made of a material that is less hard, which allows facilitating shaping by machining. For example, the insert and the connecting rod may be made of a steel or a titanium alloy. Typically, they are made of a material that has a hardness lower than 1,200 HV. The insert 5 includes two external lateral walls 5*a* over which a connecting rod 4 is respectively positioned (FIG. 6B).

The amplitude of the rotational relative movement between the secured block formed by the connecting rod 4 and the central link 2 and the lateral link 3 is limited by the two bankings 4*a*, 4*b* of the connecting rod 4 either one of which bears on a portion of the external wall 5*a* of the insert 5. More specifically, the ends of the connecting rod include two adjacent flat surfaces 4*a*, 4*b* surrounded by a circle portion 4*d* (FIG. 11). The two flat surfaces are inclined with respect to each other with an angle $\alpha$ between the two flat surfaces comprised between 10° and 220°, with this angle $\alpha$ defined with respect to the line formed by one of the two flat surfaces. This angle will define the amplitude of rotation of the lateral link about the connecting rod. Preferably, the respective bankings bear on a portion of the external wall of the insert which is a planar wall with a vertical direction as shown in FIG. 6B. By vertical direction, it should be understood the direction that is perpendicular with respect to the plane formed by the links laid flat. There is the first banking 4*a*, which occupies an upper position with respect to the second banking 4*b* which occupies a lower position. By upper position, in contrast with a lower position, it should be understood the position the closest to the top of the link. When the wristlet is laid flat, the banking 4*a* in the upper position bears on the portion of the external wall 5*a* of the insert (FIG. 6B). When the wristlet is fully pivoted, it is the banking 4*a* in the lower position which bears on the portion of the external wall of the insert (FIG. 7C). Within the lateral link, two connecting rods are respectively positioned with the first banking against the external lateral wall of the insert when the wristlet is in the flat position and with the second banking against the external lateral wall of the insert when the wristlet is in the fully pivoted position. This arrangement of the connecting rods within the lateral links allows bending the wristlet inwards as shown in FIG. 7A.

Figure 5A:
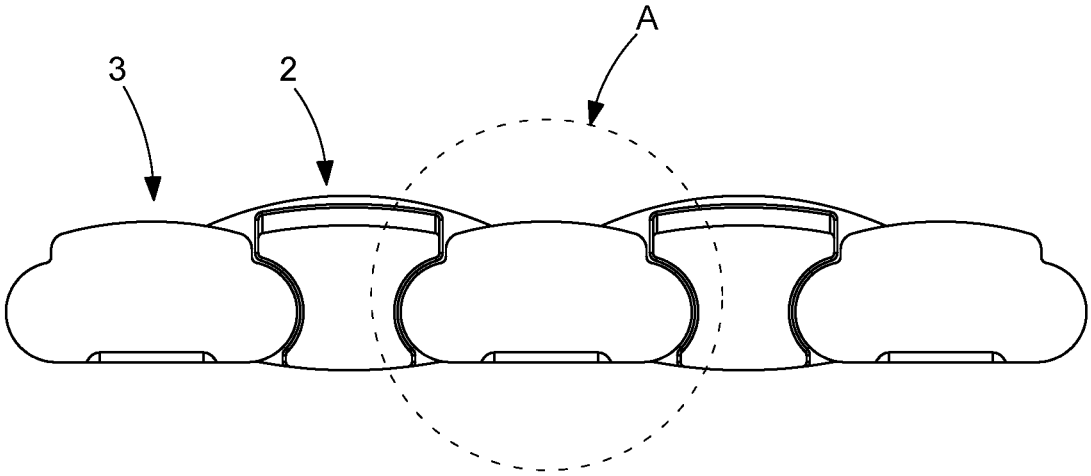
FIG. 5A is a side view of the wristlet in the flat position with an enlargement A in FIG. 5B.
Figure 5B:
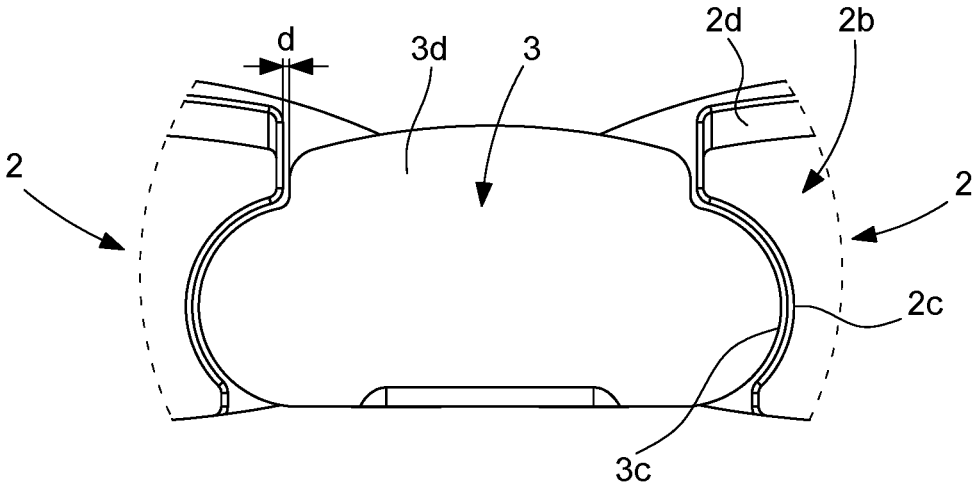

Preferably, the cap 3*e* of the lateral link 3 has a shape with two circular lugs 3*c* which are positioned in a circular recess 2*c* formed in a protruding portion 2*b* of the central link 3 disposed between the two open-through holes 2*a* (FIGS. 3 and 5B). The protruding portion 2*b* of the central link 2 is interposed between two lateral links 3 to form respectively the second row and the third row with the lateral links. Typically, the protruding portion of the central link has a thickness substantially equal to that of the lateral link. The lugs 3*c* of the lateral links 3 fit without contact within the circular recess 2*c* of the protruding portion 2*b* of the central links. The lugs 3*c* of the lateral link are topped by a portion 3*d* setback with respect to these. This setback portion 3*d* is positioned without contact opposite the top 2*d* of the protruding portion 2*b* which hangs over the recess 2*c*. The minimum space d between the top 2*d* of the protruding portion 2*b* and the setback portion 3*d* of the lateral link is observed in FIG. 5B. Positioning is done without contact to avoid stressing the hard material.

Figure 6A:
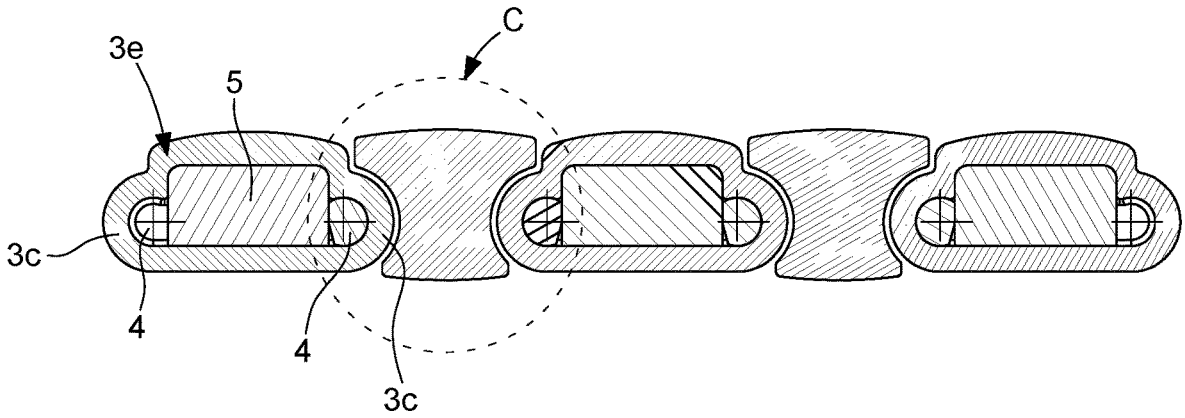
FIG. 6A is a sectional view of the wristlet according to FIG. 5A with an enlargement C in FIG. 6B.
Figure 6B:
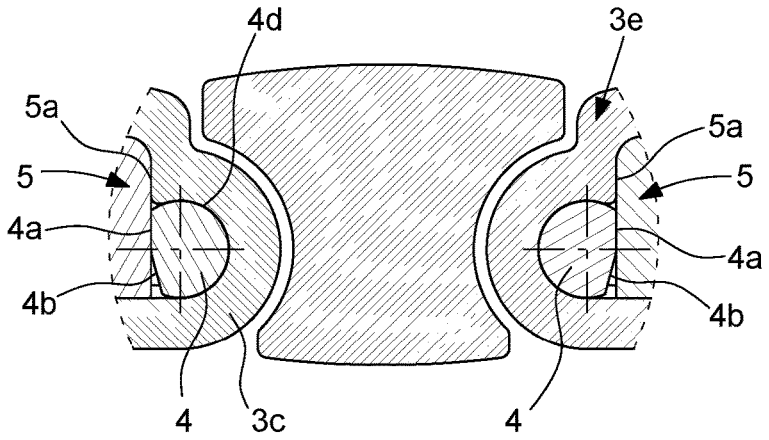
FIG. 6C is a partial sectional view of the wristlet in the flat position.
Figure 6C:
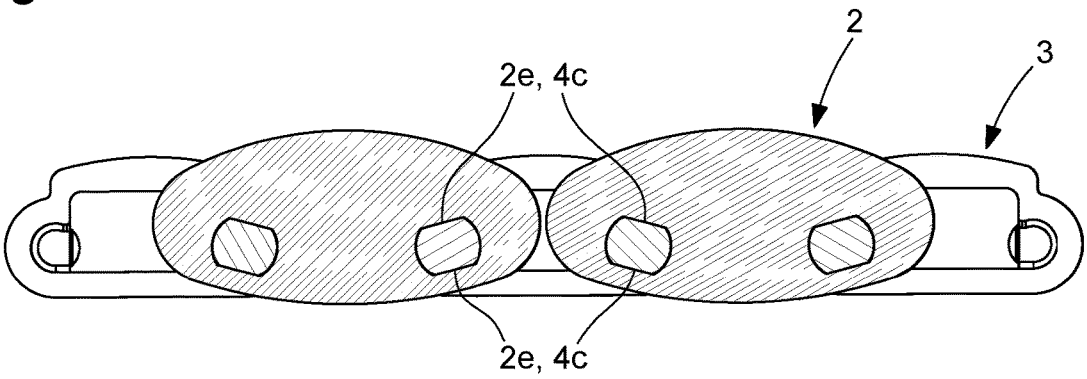

According to the invention, the insert 5 is positioned within the cap 3*e* between the two lugs 3*c* with the connecting rods 4 which fit within the hollow of the lugs 3*c* (FIGS. 6A and 6B). Advantageously, the connecting rod has a particular profile between the ends provided with the bankings 4*a*, 4*b* and the central flat surfaces 4*c* to enable positioning thereof within the circular lug against the insert. For example, the connecting rod 4 includes a portion with a circular section 4*e* following the flat surfaces 4*c* followed by a groove 4*f* before terminating in the portion with a partially circular section with the two bankings 4*a*, 4*b*. Preferably, the portion with a circular section 4*e* has a diameter substantially equal to the portion with a partially circular section with the two bankings 4*a*, 4*b*. This portion with a circular section 4*e* fits into a circular notch 5*b* formed in the lateral external wall 5*a* upon entry of the insert intended to be placed opposite the central link 2 (FIG. 2B). The groove 4*f* may be intended to receive means 5*c* for blocking the connecting rod roughly shown in FIG. 2B. These blocking means 5*c* are positioned in the insert 5 and are intended to reversibly block the connecting rod in its transverse position, i.e. In the position perpendicular to the axial direction of the connecting rod. These blocking means are disclosed in the patent EP 1 977 658.

Figure 10:
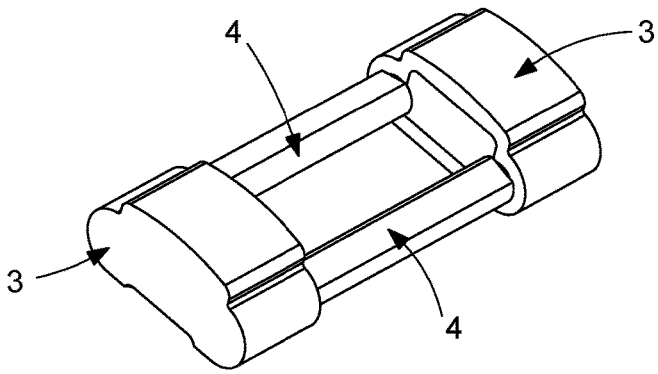

The assembly of the different elements of the wristlet is done as follows with reference to FIGS. 1 and 8 to 10. FIG. 10 shows a simplified view where the central link is absent. The end of the two connecting rods 4 is mounted between the insert 5 and the cap 3*e* within the lateral link 3. The portion with the flat surfaces 4*c* is mounted in the respective holes 2*a* of the central link 2 against the planes 2*e*. Afterwards, the lateral link 3 with the insert 5 is mounted at the other end of the two connecting rods 4 and so on to complete the assembly of the wristlet.

KEY

1. Wristlet
2. Central link
   a. Open-through hole
   b. Protruding portion
   c. Circular recess
   d. Top of the protruding portion
   e. Plane
3. Lateral link
   a. Hollow
   c. Circular lug
   d. Setback portion
   e. Cap
4. Connecting rod
   a. First flat surface at the end of the rod, also called first banking, banking of the wristlet in the flat position or banking in the upper position
   b. Second flat surface at the end of the rod, also called second banking, banking of the wristlet in the fully pivoted position or banking in the lower position
   c. Third and fourth flat surfaces between the ends of the rod
   d. Circle portion
   e. Portion with a circular section
   f. Groove
5. Insert
   a. External lateral wall
   b. Circular notch
   c. Blocking means
8. First row
9. Second row
10. Third row

The invention claimed is:

1. A wristlet comprising:

a first row of a plurality of central links, each one of said plurality of central links is provided with two open-through holes, a second row and a third row disposed respectively on either side of the first row, the second row and the third row each comprising a plurality of lateral links, each of said plurality of lateral links being provided with two lateral link holes, each lateral link hole of the second row is aligned with one of said two open-through holes of the first row and with a lateral link hole of the third row to form a set with three aligned holes, a connecting rod positioned in the three aligned holes, said connecting rod being fixedly mounted with respect to the central link of the first row and forming an axis about which the lateral link of the second row and of the third row is pivotally mounted, wherein each of the lateral links of the second row is hollow and includes, in a hollow portion, an insert delimited by two external lateral walls, the connecting rod comprising at each end a first banking and a second banking respectively bearing on a portion of one of the two external lateral walls when the lateral link of the second row pivots about the connecting rod so as to limit an amplitude of rotation of said lateral link of the second row about the connecting rod.

2. The wristlet according to claim 1, wherein the portion of the one of the two external lateral walls on which the first banking and the second banking respectively bear is a planar portion.

3. The wristlet according to claim 2, wherein the planar portion is directed in a vertical direction, said vertical direction being defined with respect to a horizontal direction wherein the wristlet is laid flat.

4. The wristlet according to claim 1, the connecting rod comprises at each end two adjacent flat surfaces which respectively form the first banking and the second banking when the lateral link of the second row pivots about the connecting rod.

5. The wristlet according to claim 4, wherein the two adjacent flat surfaces are inclined with respect to each other by an angle $\alpha$ between the two flat surfaces comprised between 10° and 220°, said angle $\alpha$ being defined with respect to a line formed by one of the two adjacent flat surfaces and defining the maximum amplitude of rotation of the lateral link of the second row about the connecting rod.

6. The wristlet according to claim 1, wherein the first banking occupies an upper position with respect to the second banking which occupies a lower position, the upper position being closer to a top of the lateral link of the second row than the lower position, and wherein when the wristlet is laid flat, the first banking in the upper position bears on the portion of the one of the two external lateral walls of the insert, and wherein when the wristlet is fully pivoted, the second banking in the lower position bears on the portion of the one of the two external lateral walls of the insert.

7. The wristlet according to claim 1, wherein each one of the plurality of central links comprises at each end between the two open-through holes a protruding portion which extends between adjacent lateral links in the second row and between adjacent lateral links in the third row.

8. The wristlet according to claim 7, wherein the protruding portion of each one of the plurality of central links has a thickness substantially equal to that of the lateral links of the second row and the lateral links of the third row.

9. The wristlet according to claim 7, wherein each of the lateral links of the second row comprises two circular lugs, each of the two circular lugs respectively fits without contact into a circular recess formed in the protruding portion of an adjacent central link of the plurality of central links.

10. The wristlet according to claim 9, wherein each end of the connecting rods is positioned against the insert in each of the two circular lugs.

11. The wristlet according to claim 1, wherein the connecting rod has a portion with a non-circular section and wherein each of the two open-through holes of each one of the plurality of central links also has a portion with a non-circular section, the portion with a non-circular section of the connecting rod fitting into the portion with a non-circular section of each of the two open-through holes of each one of the plurality of central links so that the connecting rod is fixedly mounted with respect to the respective central link.

12. The wristlet according to claim 11, wherein the portion with a non-circular section of the connecting rod comprises at least one flat surface which bears on a plane of the portion with a non-circular section of each one of the plurality of central links.

13. The wristlet according to claim 12, wherein the connecting rod comprises on each side of the portion with a non-circular section a portion with a circular section followed by a groove before terminating in the end comprising the first banking and the second banking, said first banking and said second banking being delimited by a circle portion.

14. The wristlet according to claim 13, wherein the portion with a circular section fits into a circular notch formed in the one of the two external lateral walls upon entry of the insert placed opposite each one of the plurality of central links and wherein the groove receives a device for blocking the connecting rod, the blocking device being located in the insert and allowing blocking the connecting rod in a direction perpendicular with respect to an axis of the connecting rod.

15. The wristlet according to claim 1, wherein each one of the plurality of central links and/or each of said plurality of lateral links of the second and third rows is at least partially made of a material whose hardness is equal to or higher than 1,200 HV.

16. The wristlet according to claim 1, wherein the insert and the connecting rod are made of a material having a hardness lower than 1,200 HV.

17. A timepiece, comprising the wristlet according to claim 1.

* * * * *